US006677416B2

(12) United States Patent
Sato et al.

(10) Patent No.: US 6,677,416 B2
(45) Date of Patent: Jan. 13, 2004

(54) VINYLIDENE FLUORIDE RESIN MONOFILAMENT AND METHOD FOR PRODUCING THE SAME

(75) Inventors: Takashi Sato, Ibaraki (JP); Kazuyuki Munakata, Ibaraki (JP); Shingo Imamura, Ibaraki (JP)

(73) Assignee: Kureha Chemical Industry Company, Limited (JP)

( * ) Notice: Subject to any disclaimer, the term of this patent is extended or adjusted under 35 U.S.C. 154(b) by 0 days.

(21) Appl. No.: 10/169,476

(22) PCT Filed: Dec. 25, 2000

(86) PCT No.: PCT/JP00/09191

§ 371 (c)(1),
(2), (4) Date: Jun. 27, 2002

(87) PCT Pub. No.: WO01/53574

PCT Pub. Date: Jul. 26, 2001

(65) Prior Publication Data

US 2003/0004292 A1 Jan. 2, 2003

(30) Foreign Application Priority Data

Jan. 18, 2000 (JP) ..... 2000-9407

(51) Int. Cl.[7] ..... C08F 14/18
(52) U.S. Cl. ..... 526/255; 526/250
(58) Field of Search ..... 526/200, 255

(56) References Cited

U.S. PATENT DOCUMENTS 4,521,483 A * 6/1985 Sasaski ..... 428/373
4,606,144 A * 8/1986 Sasaki ..... 428/364
4,629,654 A * 12/1986 Sasaki ..... 428/375
5,845,430 A * 12/1998 Nakano ..... 43/44.98
6,132,869 A * 10/2000 Ohira ..... 428/364
6,136,437 A * 10/2000 Reiter ..... 428/373
6,170,192 B1 * 1/2001 Nakano ..... 43/44.98

FOREIGN PATENT DOCUMENTS

| | | |
|---|---|---|
| JP | 60/209009 | 10/1985 |
| JP | 04-091215 | 3/1992 |
| JP | 05-148707 | 6/1993 |
| JP | 06-101114 | 4/1994 |
| JP | 07-054210 | 2/1995 |
| JP | 07-054211 | 2/1995 |
| JP | 07-138810 | 5/1995 |
| JP | WO 98/48087 | 10/1998 |
| JP | 10-298825 | 11/1998 |
| JP | 11-131320 | 5/1999 |

* cited by examiner

*Primary Examiner*—Bernard Lipman
(74) *Attorney, Agent, or Firm*—Beyer Weaver & Thomas, LLP

(57) ABSTRACT

A production method of a PVDF monofilament according to the present invention comprises a drawing step of drawing a melt-spun PVDF monofilament; and a dry thermal relaxation treatment step of subjecting the drawn PVDF monofilament to a relaxation thermal treatment in a gas phase at a temperature between 220° C. inclusive and 300° C. and under such conditions that a relaxation rate falls between 4% inclusive and 10% and that a passing time is not more than 5 seconds, thereby obtaining the PVDF monofilament satisfying the relation represented by Eq (1) below;

$$Y \geqq d^3 \times 2 \times 10^{-7} - d^2 \times 2 \times 10^{-4} + d \times 1.17 \times 10^{-2} + 73.11 \quad (1)$$

(where d indicates a diameter ($\mu$m) and Y a knot strength (kgf/mm$^2$)) and having a knot elongation of not less than 24% and a straight elongation of not less than 30%.

3 Claims, No Drawings

VINYLIDENE FLUORIDE RESIN MONOFILAMENT AND METHOD FOR PRODUCING THE SAME

TECHNICAL FIELD

The present invention relates to a vinylidene fluoride resin monofilament and a production method thereof.

BACKGROUND ART

A monofilament made of vinylidene fluoride resin is of use as a material, for example, for fishing lines, fishing nets, rope materials, and so on because of its excellent physical and chemical properties, particularly, the properties including excellent mechanical strength and durability, little swelling with water leading to little degradation of strength in water, and so on. Among these uses, the filament, particularly, for the fishing lines is required to have the property of leaving less "twisting" or "curling" due to a winding propensity and the property of easily relieving the winding propensity, the property of demonstrating high mechanical strength, e.g., knot strength with a knot in the filament, and so on.

The conventional vinylidene fluoride resin monofilaments applied to the fishing lines required to satisfy such various properties include, for example those described in 1) Japanese Patent Application Laid-Open No. 10-298825 filed by Applicant, 2) Japanese Patent Applications Laid-Open No. 04-91215 and No. 07-138810, 3) Japanese Patent Application Laid-Open No. 11-131320 filed by Applicant, and so on.

DISCLOSURE OF THE INVENTION

Incidentally, in order to enhance the knot strength of the vinylidene fluoride resin monofilament, an effective way is to increase the drawing ratio in production to orient the filament in high degree of orientation, but the highly oriented monofilament tends to have the winding propensity easier. The vinylidene fluoride resin monofilament described in above 1) was improved in the winding propensity by setting of the low drawing ratio in production, but this resulted in insufficient improvement in the knot strength.

On the other hand, the vinylidene fluoride resin monofilaments described in above 2) were intended for improvement in the knot strength or improvement in wear resistance, but were not intended for improvement in the winding propensity. Further, the vinylidene fluoride resin monofilament described in above 3) was one obtained by subjecting a highly oriented monofilament in a fixed length state to a thermal treatment at a fixed temperature for a fixed period of time. This achieved the improvement in the winding propensity while preventing the degradation of mechanical strength. However, this thermal treatment in the fixed length state had to be carried out with the use of a large-diameter bobbin over a long period of time, and the batch treatment raised the problem of degradation of productivity.

Therefore, the present invention has been accomplished under such circumstances and an object of the present invention is to provide a vinylidene fluoride resin monofilament and a production method thereof capable of increasing the production efficiency while achieving both satisfactory knot strength and improving capability of the winding propensity.

In order to achieve the above object, the inventors have conducted elaborate research and found out the relaxation thermal treatment conditions for satisfactorily restraining the degradation of the knot strength. From the viewpoint associated with the properties of the vinylidene fluoride resin monofilament, the inventors found that a vinylidene fluoride resin monofilament satisfying a predetermined knot strength according to the filament size and having a predetermined knot elongation and linear elongation is excellent in the improving capability of the winding propensity, thus accomplishing the present invention.

Namely, a vinylidene fluoride resin monofilament according to the present invention is a vinylidene fluoride resin monofilament comprising a vinylidene fluoride resin and satisfies the relation represented by Eq (1) below;

$$Y \geqq d^3 \times 2 \times 10^{-7} - d^2 \times 2 \times 10^{-4} + d \times 1.17 \times 10^{-2} + 73.11 \quad (1),$$

wherein a knot elongation is not less than 24% and a straight elongation is not less than 30%. In the equation, d indicates the diameter ($\mu$m) of the monofilament, and Y a knot strength (kgf/mm$^2$) thereof.

It was proved that such a vinylidene fluoride resin monofilament had the sufficient knot strength comparable to those of the conventional monofilaments and enhanced its improving capability of the winding propensity. Here the diameter d of the monofilament is preferably 0.05–1.85 mm and more preferably 290–550 $\mu$m.

A production method of the vinylidene fluoride resin monofilament according to the present invention is a production method suitable for production of the vinylidene fluoride resin monofilament of the present invention, which comprises a drawing step of drawing a melt-spun vinylidene fluoride resin monofilament; and a dry thermal relaxation treatment step of subjecting the vinylidene fluoride resin monofilament thus drawn, to a relaxation thermal treatment in a gas phase at a temperature between 220° C. inclusive and 300° C., preferably between 250 and 290° C., and under such conditions that a relaxation rate falls between 4% inclusive and 10%, preferably between 7 and 9%, and that a passing time is not more than 5 seconds, preferably between 1 and 5 seconds. In the normal relaxation thermal treatment, the degradation of the mechanical strength, e.g., the knot strength, tends to become more prominent with increase in the relaxation rate. In contrast to it, according to the present invention, the knot strength of the vinylidene fluoride resin monofilament before the relaxation thermal treatment is maintained or is little degraded even if the relaxation rate is so high as in the above range, and the improving capability of the winding propensity is enhanced.

Further, it is extremely preferable for the production of the vinylidene fluoride resin monofilament of the present invention that in the drawing step, the melt-spun vinylidene fluoride resin monofilament is drawn at a drawing ratio of not less than 5.9, more preferably 5.9–6.2.

The terms "straight elongation," "knot strength," "knot elongation," and "passing time" in the present invention are values defined as below. If the drawing process involves two or more stages of drawing, the "drawing ratio" refers to a total value of drawing ratios in respective stages, i.e., an overall drawing ratio at an end of the drawing process.

<Straight elongation>: ultimate elongation under ordinary temperature of a sample filament drawn with TENSILON/UTM-III-100 available from TOYO BALDWIN Co., LTD and under the conditions of the chuck-chuck distance (sample length) of 30 cm and the drawing speed (head speed) of 30 cm/min.

<Knot strength and knot elongation>: breaking tenacity and elongation of a sample filament with a knot in central part of the sample length, drawn as in the measurement of the foregoing straight elongation.

<Passing time>: time in which a predetermined portion of the vinylidene fluoride resin monofilament passes through the gas phase or for which it stays in the gas phase.

Best Mode for Carrying Out the Invention

The following will describe the preferred embodiments of the vinylidene fluoride resin monofilament and production method thereof according to the present invention.

Vinylidene Fluoride Resin

A homopolymer of vinylidene fluoride can be preferably used as the vinylidene fluoride resin used in the present invention. Without having to be limited to this, other applicable vinylidene fluoride resins include copolymers of a vinylidene fluoride monomer and one or more monomers copolymerizable therewith; mixtures of these copolymers with the homopolymer of vinylidene fluoride; and so on.

Examples of the monomers copolymerizable with vinylidene fluoride include tetrafluoroethylene, hexafluoropropylene, trifluoroethylene, chlorotrifluoroethylene, vinyl fluoride, and so on, which can be used singly or in a mixed state of two or more monomers. The content of vinylidene fluoride units in these vinylidene fluoride resins is preferably not less than 50 mol %, more preferably not less than 60 mol %, and particularly preferably not less than 80 mol %.

The vinylidene fluoride resin is desired to have such a degree of polymerization that the inherent viscosity (logarithmic viscosity number at 30° C. of a solution in which 4 g of the resin is dissolved in 1 l of N,N-dimethylformamide; which will be referred to hereinafter as "$\eta_{inh}$") falls preferably in the range of 0.5 to 2.0 dl/g and more preferably in the range of 1.0 to 1.8 dl/g.

Further, the vinylidene fluoride resin as a raw material for the vinylidene fluoride resin monofilament of the present invention may contain one or more selected from the following group in an amount not impairing its properties: additives such as various organic pigments and others; polyester base plasticizers; phthalate base plasticizers; nucleating agents typified by flavanthrone; compositions containing a resin with high compatibility with the vinylidene fluoride resin, e.g., poly((meth)acrylic acid ester), polycarbonate, polyester, a methyl acrylate-isobutylene copolymer, or the like; and so on. The content of the vinylidene fluoride resin in such compositions is preferably not less than 60% by mass and more preferably not less than 70% by mass.

Preferable examples of the foregoing plasticizers are polyesters having repeating structural units of an ester comprised of a C2–C4 diol and a C4–C6 dicarboxylic acid, having a terminal group of a C1–C3 monovalent acid residue or monovalent alcohol residue, and having the molecular weight of 1500–4000.

Vinylidene Fluoride Resin Monofilament

The vinylidene fluoride resin (hereinafter referred to "PVDF" on behalf of the resin) monofilament of the present invention is constructed of a single layer or plural layers and at least the surface layer (sheath) thereof is made of PVDF. Namely, the monofilament may be comprised of a single layer of PVDF, or may be comprised of plural layers, wherein an internal layer (core) is comprised of a single layer or plural layers made of thermoplastic resin except for PVDF, e.g., polyamide, polyolefin, or the like and wherein the outermost layer (sheath) is made of PVDF. Preferably, the whole of the monofilament is made of PVDF in either case where the monofilament is constructed of a single layer or plural layers.

The PVDF monofilament of the present invention satisfies the relation represented by Eq (1) below;

$$Y \geqq d^3 \times 2 \times 10^{-7} - d^2 \times 2 \times 10^{-4} + d \times 1.17 \times 10^{-2} + 73.11 \quad (1),$$

where d ($\mu$m) is the filament size (diameter) thereof and Y (kgf/mm$^2$) the knot strength, and the PVDF monofilament of the present invention has the knot elongation of not less than 24% and the straight elongation of not less than 30%.

If the knot strength in Eq (1) is less than the value given by the right side in the equation, there is an increasing tendency to become hard to satisfy the sufficient knot strength required for the filament size; specifically, for example, when a knot is formed in a leader or a fed part of a fishing line, there is a tendency to cause fracture easily at the knot. Further, if the knot elongation is less than 24% and if the straight elongation is less than 30%, it tends to be hard to satisfactorily absorb impact when a fish or the like takes a fish hook coupled to a fishing line, particularly, impact in an initial stage of taking or during biting, and the line becomes easier to curl and tends to resist correction for curling.

Conversion of units of strength can be made based on the relation represented by 1 kgf/mm$^2$≈9.80665 MPa, and Eq (1) can be converted into the Pa unit, i.e., the relation represented by Eq (2) below;

$$y \geqq d^3 \times 1.96 \times 10^{-6} - d^2 \times 1.96 \times 10^{-3} + d \times 1.15 \times 10^{-1} + 717 \quad (2).$$

In this equation, d indicates the filament size (diameter) ($\mu$m) and y the knot strength (MPa).

There are no specific restrictions on the filament size (diameter), but d in Eq (1) above is preferably in the range of 52 $\mu$m (corresponding to Number 0.1 of fishing line) to 1.81 mm (corresponding to Number 120) and particularly preferably in the range of 50 to 1000 $\mu$m.

It was verified with the PVDF monofilament of the present invention satisfying the various conditions as described above that it had the knot strength comparable to those of the conventional filaments and demonstrated significant improvement in the winding propensity. Therefore, when the monofilament is applied to a fishing line, there remains little winding after it is wound on a cylindrical member such as a spool or the like, and it is excellent in the improving capability of the winding propensity even if there occurs twisting or curling due to the winding propensity. Accordingly, slack is reduced in the fishing line put in water, so as to enhance sensitivity to "strike" (bite). Further, the property of less twisting can enhance handleability and, particularly, the handleability is remarkably improved when the PVDF monofilament of small diameter is handled in a long unit.

The following will describe the preferred embodiment of the production method of the PVDF monofilament according to the present invention. First, a mixed composition of the aforementioned vinylidene fluoride resin and plasticizer and others is melted and extruded to form pellets thereof. These pellets are charged into a melt extruder having a predetermined size, e.g., 20–40 mmΦ and a monofilament is melt-spun at a predetermined resin temperature, e.g., at 240–310° C. by the extruder. Subsequently, the melt-spun monofilament is cooled in a coolant bath (e.g., a water bath at the temperature of 30 to 60° C.) to obtain an undrawn PVDF monofilament.

Here a PVDF monofilament consisting of a single layer can be made of a single kind of vinylidene fluoride resin, and a PVDF monofilament consisting of plural layers can be made of materials selected from vinylidene fluoride resins with different or close compositions, viscosities, additives, etc., other resins, compositions containing either of these, or mixtures of these resins or compositions. As described previously, in the case of the PVDF monofilament comprised of plural layers, the sheath can be made of the vinylidene fluoride resin or a composition thereof, and the core can be made of one selected from the vinylidene fluoride resins, other resins, compositions containing either of these, or mixtures of these resins or compositions.

Subsequently, the resultant undrawn PVDF monofilament is then drawn in a heating medium bath (e.g., a glycerin bath at the temperature of 150–170° C.), e.g., at the drawing ratio of about 5–6 (first stage drawing). This is further drawn in a heating medium bath (e.g., a glycerin bath at the temperature of 160–175° C.), e.g., at the drawing ratio of about 1–1.2 (second stage drawing). In this way, the drawing step is comprised of the first stage drawing and the second stage drawing.

There are no specific restrictions on the overall drawing ratio in this drawing step, but it is desirable in the present invention that the drawing ratio be preferably not less than 5.9 and more preferably not less than 6. This enhances the degree of orientation of molecular chains in the vinylidene fluoride resin, which is suitable for the production of the PVDF monofilament of the present invention with the foregoing sufficient knot strength (cf. Eq (1)). The drawing ratio can be appropriately selected according to the knot strength required of each fishing line.

Then the drawn PVDF monofilament is subjected to a relaxation thermal treatment in a gas phase (e.g., air, an inert gas, or the like) at the temperature between 220° C. inclusive and 300° C., preferably between 250 and 290° C., and under such conditions that the relaxation rate falls between 4% inclusive and 10%, preferably between 7 and 9%, and that the passing time is not more than 5 seconds, preferably between 1 and 5 seconds (dry thermal relaxation treatment step).

If the above gas phase temperature is less than 220° C., it is difficult to achieve the relaxation rate of 4%, which will result in failure in enhancing the knot elongation or the straight elongation satisfactorily and a tendency to fail to achieve the sufficient improving effect of the winding propensity. If the gas phase temperature exceeds 300° C. on the other hand, there appears a tendency that the degradation becomes prominent in the mechanical strength, e.g., the knot strength. When the aforementioned relaxation rate is less than 4%, the winding propensity and elongation tend not to be improved well, as described above. When the relaxation rate is 10% or more on the other hand, the knot strength can be heavily degraded. Further, when the foregoing passing time exceeds five seconds, the PVDF monofilament can be melted, depending upon the melting point of the vinylidene fluoride resin.

The production method of the PVDF monofilament according to the present invention can satisfactorily restrain the degradation of the mechanical strength, e.g., the knot strength of the drawn PVDF monofilament, as compared with the conventional relaxation thermal treatment, and can maintain the mechanical strength of the PVDF monofilament enhanced by the drawing, at an excellent level. In addition, the improving capability of the winding propensity can be enhanced, and it is thus feasible to obtain the PVDF monofilament extremely suitable for the fishing lines.

Further, the relaxation thermal treatment as described above can improve the winding propensity while preventing the degradation of the knot strength, thereby providing the PVDF monofilament with excellent properties equivalent to or higher than those achieved by the conventional fixed-length thermal treatment. In production of a long monofilament like the fishing line, the filament can be made in a continuous process, without the need for the batch long-time thermal treatment with the use of the large-diameter bobbin. The production efficiency of the PVDF monofilament can be remarkably increased accordingly.

It is also possible to carry out a relaxation thermal treatment of thermally relaxing the drawn PVDF monofilament in a heating medium such as hot water, hot air, or the like (e.g., at the temperature of about 85° C.), prior to the aforementioned dry thermal relaxation treatment step.

EXAMPLES

Specific examples of the present invention will be described below, but it is noted that the present invention is by no means intended to be limited to these examples.

Method of Measuring Winding Propensity

A PVDF monofilament sample having the length of about 50 m was wound around a small winding spool having the diameter of 44 mm and was allowed to stand at room temperature for seven days. Thereafter, the sample was fed out by 1 m (this length being referred to as a (m)), and the sample was suspended with one end thereof being supported. In this state, the perpendicular length to the bottom level of the pendent sample, i.e., the distance between the supported end and the bottom level (this distance being referred to as $b_1$ (m)) was measured. The ratio of this measurement $b_1$ to the original length a (this ratio being referred to as c; i.e., $c=b_1/a$) was defined as an index for the winding propensity (curling and twisting) of the sample. A sample with no winding propensity provides c=1. As the value of c decreases, the curling of the filament becomes greater because of the shape of the spool, indicating that the winding propensity becomes easier to remain.

Improvability of Winding Propensity

The weight of 1160 g was put on the lower end of the sample with the winding propensity made in the above <Method of measuring winding propensity>, and the sample was allowed to stand in that state for ten seconds. Then the weight was removed, and the perpendicular length to the position of the bottom part of the sample, i.e., the distance between the supported end and the bottom part (this length being referred to as $b_2$ (m)) was measured. The ratio of this measurement $b_2$ to the original length a (this ratio being referred to as e; i.e., $e=b_2/a$) was defined as an index for relievability (improvability) of the winding propensity of the sample. A sample in a completely relieved state of the winding propensity provides e=1. As the value of e approaches 1, it becomes easier to relieve the winding propensity.

Comparative Example 1

A monofilament with the sheath and core of respective vinylidene fluoride resins of $\eta_{inh}$=1.3 and 1.55 was melt-spun with the melt extruder of 35 mmΦ and at the resin temperature of 280° C. and cooled in a water bath of 60° C., thereby obtaining an undrawn PVDF monofilament (which will be referred to hereinafter simply as "undrawn filament"). This undrawn filament was drawn in a glycerin bath of 169° C. and at the drawing ratio of 5.82 (first stage drawing) and was further drawn as second stage drawing in a glycerin bath of 170° C. up to the total drawing ratio of 6.17. After the drawing step, the drawn filament was subjected to the relaxation heat treatment at the relaxation rate of 3% in hot water of 85° C. to obtain the drawn filament having the filament size of 290 μm.

Example 1

The drawn filament obtained in Comparative Example 1 was subjected to the dry thermal relaxation treatment in air of 250° C. and under the conditions of the relaxation rate of 5% and the passing time of 1.7 seconds.

Comparative Example 2

The drawn filament obtained in Comparative Example 1 was subjected to the dry thermal relaxation treatment in air of 250° C. and under the conditions of the relaxation rate of 0% and the passing time of 1.7 seconds.

Comparative Example 3

The drawn filament obtained in Comparative Example 1 was subjected to the dry thermal relaxation treatment in air of 215° C. and under the conditions of the relaxation rate of 5% and the passing time of 1.7 seconds.

Comparative Example 4

The drawn filament obtained in Comparative Example 1 was subjected to the dry thermal relaxation treatment in air of 300° C. and under the conditions of the relaxation rate of 5% and the passing time of 1.7 seconds.

Comparative Example 5

The drawn filament obtained in Comparative Example 1 was subjected to the dry thermal relaxation treatment in air of 250° C. and under the conditions of the relaxation rate of 10% and the passing time of 1.7 seconds.

Comparative Example 6

A monofilament with the sheath and core of respective vinylidene fluoride resins of $\eta_{inh}$=1.3 and 1.55 was melt-spun with the melt extruder of 35 mmΦ and at the resin temperature of 280° C. and cooled in the water bath of 60° C., thereby obtaining an undrawn filament. This undrawn filament was drawn in the glycerin bath of 169° C. and at the drawing ratio of 5.82 (first stage drawing), and was further drawn as second stage drawing in the glycerin bath of 170° C. up to the total drawing ratio of 6.17, thereby obtaining a drawn filament having the fiber size of 297 μm.

Example 2

The drawn filament obtained in Comparative Example 6 was subjected to the dry thermal relaxation treatment in air of 270° C. and under the conditions of the relaxation rate of 7% and the passing time of 1.6 seconds.

Example 3

The drawn filament obtained in Comparative Example 6 was subjected to the dry thermal relaxation treatment in air of 270° C. and under the conditions of the relaxation rate of 8% and the passing time of 1.1 seconds.

Example 4

The drawn filament obtained in Comparative Example 6 was subjected to the dry thermal relaxation treatment in air of 290° C. and under the conditions of the relaxation rate of 8% and the passing time of 1.7 seconds.

Comparative Example 7

The drawn filament obtained in Comparative Example 6 was subjected to the dry thermal relaxation treatment in air of 270° C. and under the conditions of the relaxation rate of 2% and the passing time of 1.1 seconds.

Comparative Example 8

A monofilament with the sheath and core of respective vinylidene fluoride resins of $\eta_{inh}$=1.3 and 1.55 was melt-spun with the melt extruder of 35 mmΦ and at the resin temperature of 280° C. and cooled in the water bath of 60° C., thereby obtaining an undrawn filament. This undrawn filament was drawn in the glycerin bath of 169° C. and at the drawing ratio of 5.64 (first stage drawing), and was further drawn as second stage drawing in the glycerin bath of 170° C. up to the total drawing ratio of 5.92, thereby obtaining a drawn filament having the fiber size of 532 μm.

Example 5

The drawn filament obtained in Comparative Example 8 was subjected to the dry thermal relaxation treatment in air of 270° C. and under the conditions of the relaxation rate of 7% and the passing time of 4.0 seconds.

Property Evaluation Tests

The PVDF monofilaments obtained in the respective examples and comparative examples were evaluated by measuring the aforementioned "linear elongation," "knot strength," and "knot elongation." The index c for the winding propensity and the index e for the improvability of the winding propensity were determined according to the measuring methods described above. The results are presented together in Table 1.

TABLE 1

| | | Dry relaxation treatment conditions | | | | | | | |
|---|---|---|---|---|---|---|---|---|---|
| | Diameter (μm) | Air temperature (° C.) | Relaxation rate (%) | Passing time (sec) | Knot strength (kgf/mm²) | Knot elongation (%) | Straight elongation (%) | Index c for winding propensity | Index e for improvability of winding propensity |
| Example 1 | 296 | 250 | 5 | 1.7 | 64.8 | 26 | 33 | 0.89 | 1 |
| Comparative Example 1 | 290 | Not executed | | | 65.1 | 21 | 29 | 0.82 | 0.94 |
| Comparative Example 2 | 290 | 250 | 0 | 1.7 | 65.6 | 21 | 29 | 0.83 | 0.94 |
| Comparative Example 3 | 297 | 215 | 5 | 1.7 | 59.5 | 23 | 30 | Not measured | Not measured |
| Comparative Example 4 | 299 | 300 | 5 | 1.7 | 60.8 | 26 | 34 | Not measured | Not measured |
| Comparative Example 5 | 304 | 250 | 10 | 1.7 | 56.9 | 27 | 41 | Not measured | Not measured |
| Example2 | 307 | 270 | 7 | 1.6 | 64.5 | 25 | 32 | 0.88 | 1 |

TABLE 1-continued

| | Diameter (μm) | Dry relaxation treatment conditions: Air temperature (° C.) | Relaxation rate (%) | Passing time (sec) | Knot strength (kgf/mm²) | Knot elongation (%) | Straight elongation (%) | Index c for winding propensity | Index e for improvability of winding propensity |
|---|---|---|---|---|---|---|---|---|---|
| Example3 | 304 | 270 | 8 | 1.1 | 64.0 | 25 | 30 | 0.88 | 1 |
| Example4 | 308 | 290 | 8 | 1.7 | 64.4 | 26 | 33 | 0.89 | 1 |
| Comparative Example 6 | 297 | Not executed | | | 66.3 | 19 | 27 | 0.78 | 0.91 |
| Comparative Example 7 | 298 | 270 | 2 | 1.1 | 66.7 | 20 | 25 | 0.79 | 0.91 |
| Example5 | 545 | 270 | 7 | 4 | 54.3 | 27 | 33 | 0.66 | 0.85 |
| Comparative Example 8 | 532 | Not executed | | | 54.8 | 21 | 26 | 0.62 | 0.72 |

As seen from Table 1, it was first found from comparison between Example 1 and Comparative Example 1, comparison between Examples 2–4 and Comparative Example 6, and comparison between Example 3 and Comparative Example 8 that the PVDF monofilaments of the present invention were less likely to have the winding propensity than and significantly superior in the improvability of the winding propensity to the conventional PVDF monofilaments produced without the dry thermal relaxation treatment step.

It was also verified from comparison between Example 1 and Comparative Examples 3–5 that the degradation of the knot strength became noticeable when the gas phase temperature (air temperature) in the dry thermal relaxation treatment step was outside the range of the present invention (the range between 220° C. inclusive and 300° C.) and that the degradation of the knot strength became greater when the relaxation rate exceeded 10%. Further, it was found from comparison between Example 1 and Comparative Example 2 and comparison between Examples 2–4 and Comparative Example 7 that if the relaxation rate was small (0% or 2%) it was hard to achieve the satisfactory knot elongation and linear elongation and no improving effect was achieved in the winding propensity.

Industrial Applicability

As described above, the vinylidene fluoride resin monofilament of the present invention is one satisfying both the sufficient knot strength and the improvability of the winding propensity and achieving increase in the production efficiency. The production method of the vinylidene fluoride resin monofilament of the present invention is a method capable of producing the vinylidene fluoride resin monofilament with satisfactory knot strength, resistance to the winding propensity, and excellent improvability of the winding propensity while enhancing the productivity of the vinylidene fluoride resin monofilament.

What is claimed is:

1. A vinylidene fluoride resin monofilament comprising a vinylidene fluoride resin, and satisfying the relation represented by Eq (1) below;

$$Y \geqq d^3 \times 2 \times 10^{-7} - d^2 \times 2 \times 10^{-4} + d \times 1.17 \times 10^{-2} + 73.11 \quad (1)$$

d: diameter (μm)

Y: knot strength (kgf/mm²), wherein a knot elongation is not less than 24% and a straight elongation is not less than 30%.

2. The vinylidene fluoride resin monofilament according to claim 1, wherein said diameter d is 0.05–1.85 mm.

3. The vinylidene fluoride resin monofilament according to claim 1, wherein said diameter d is 290–550 μm.

* * * * *